US006719652B1

(12) United States Patent
Rhodes, Jr.

(10) Patent No.: US 6,719,652 B1
(45) Date of Patent: Apr. 13, 2004

(54) ARROW FOR PROVIDING AN EXIT FOR FLUID FROM GAME UPON IMPACT IN THE GAME

(76) Inventor: Theodore D. Rhodes, Jr., Box 1098, Dix Run Rd., Julian, PA (US) 16844

( * ) Notice: Subject to any disclaimer, the term of this patent is extended or adjusted under 35 U.S.C. 154(b) by 0 days.

(21) Appl. No.: 10/197,923

(22) Filed: Jul. 17, 2002

(51) Int. Cl.[7] ..... F42B 6/04
(52) U.S. Cl. ..... 473/581
(58) Field of Search ..... 473/581

(56) References Cited

U.S. PATENT DOCUMENTS

| | | | | |
|---|---|---|---|---|
| 2,554,012 A | | 5/1951 | Cohen | |
| 3,617,060 A | | 11/1971 | Iezzi | |
| 3,993,311 A | | 11/1976 | Johnson | |
| 4,212,463 A | | 7/1980 | Repinski et al. | |
| 4,252,325 A | | 2/1981 | Weems et al. | |
| 4,277,069 A | | 7/1981 | Rouse | |
| 4,380,340 A | | 4/1983 | Simo | |
| 4,836,557 A | | 6/1989 | Polando | |
| 6,015,357 A | | 1/2000 | Rizza | |
| 6,059,677 A | * | 5/2000 | Breshears | 473/581 |

* cited by examiner

*Primary Examiner*—John A. Ricci
(74) *Attorney, Agent, or Firm*—Richard L. Miller

(57) ABSTRACT

An arrow including a shaft and an adapter. The adapter portion is initially in an extended position where its rearwardmost end closes a fluid-entering throughslot in a leading portion of the shaft to prevent air intake therethrough and eddy currents produced thereby that effect flight of the arrow, but upon, and by, impact in the game, the adapter portion is moved to a retracted position where its rearwardmost end is moved rearwardly allowing the fluid-entering throughslot to communicate with a pin-riding/fluid entering throughslot in the adapter portion and provide an entrance for fluid from game to enter, then run through a fluid-carrying conduit in the adapter portion, and then out of a fluid-exiting throughbore in the leading portion of the shaft so as to make a quicker and ethical kill of the game and provide a trail to follow to locate the game.

9 Claims, 1 Drawing Sheet

(EXTENDED POSITION)

(RETRACTED POSITION)

ARROW FOR PROVIDING AN EXIT FOR FLUID FROM GAME UPON IMPACT IN THE GAME

BACKGROUND OF THE INVENTION

1. Field of the Invention

The present invention relates to an arrow. More particularly, the present invention relates to an arrow for providing an exit for fluid from game upon impact in the game so as to make a quicker and ethical kill of the game and provide a trail to follow to locate the game.

2. Description of the Prior Art

Numerous innovations for arrow related devices have been provided in the prior art that will be described. Even though these innovations may be suitable for the specific individual purposes to which they address, however, they differ from the present invention.

A FIRST EXAMPLE, U.S. Pat. No. 2,554,012 to Cohen teaches a missile hollow throughout its length having relatively thin walls formed with a plurality of holes, a pointed forward end comprising a plurality of angular blades on an arrow head, and a stopper at the opposite end of said missile closing the opposite end of said hollow.

A SECOND EXAMPLE, U.S. Pat. No. 3,617,060 to Iezzi teaches a hunting arrow provided with a hollow shaft perforated along is length. An adapter is connected to the forward end of the shaft and has a longitudinal passage in communication with the hollow shaft, and transverse passages communicating to the atmosphere. An arrowhead is fitted over the adapter with the transverse passages of the adapter being disposed between the ends of the blades of the arrowhead. Where the ferrule overlies the transverse passages, it is formed with openings.

A THIRD EXAMPLE, U.S. Pat. No. 3,993,311 to Johnson teaches a hunting arrow that will cause massive bleeding in wounded game, thus hastening the death of the game and facilitating the tracking thereof. The arrow is comprised of hollow inner shaft, a hollow outer shaft which is slightly shorter than the inner shaft and which is slidably mounted thereon, a nock which is friction fitted in the outer shaft, an arrowhead which is mounted to the inner shaft and a short length of high strength line connected to the nock and to the arrowhead and disposed within the inner shaft. Upon impact with the game, the outer shaft will slide forward causing the rear end of the inner shaft to dislodge the nock from the outer shaft. The nock will fall to the ground and become entangled in the brush, thus pulling back on the arrowhead by means of the high strength line.

A FOURTH EXAMPLE, U.S. Pat. No. 4,212,463 to Repinski et al. teaches a humane hunting arrow which is particularly designed to most effectively obtain the utmost bleed-out possible for a given hit in the shortest period of time. The shaft of the arrow is hollow and is designed to facilitate passage of blood therethrough. Further, the shaft may be provided, either on its inside or outside surfaces, with one or a plurality of weakened areas in the form of grooves, scratches, scored or marked lines, or the like, for facilitating shearing of the arrow shaft thereat after the hit has been registered. Clean breakage of the arrow shaft at the point adjacent the animal's flesh facilitates bleed-out. The broadhead arrow tip includes an opening for creating a reservoir near the open front end of the arrow shaft for further facilitating and expediting the passage of blood therethrough. The element for attaching the broadhead to the shaft allows the complete inside diameter of the arrow shaft to be free of obstructions to further facilitate bleed-out. The attachment element further provides a tension arrangement which allows the pointed broadhead to easily enter the hide and to slide off bone and hard cartilage beneath the hide to enable the broadhead to penetrate the flesh of the animal deep enough to even further facilitate bleed-out.

A FIFTH EXAMPLE, U.S. Pat. No. 4,252,325 to Weems et al. teaches a hunting arrow that causes a continuation of the bleeding in wounded game. The arrow embodies a hollow shaft having a forward end and a rearward end with an arrow mounted at the forward end and a nock mounted at the rear end thereof. A length of high strength line within the hollow shaft is fixedly connected at one end to the rearward end of the shaft and the other end of the line is fixedly connected to the arrowhead so that in the event the hollow shaft is broken the line still interconnects and limits relative movement of the broken parts of the shaft whereby they move along with the arrowhead and the game.

A SIXTH EXAMPLE, U.S. Pat. No. 4,277,069 to Rouse teaches an arrow for blood tracking comprising an elongated tubular shank having a head at one end and a nock at its other end, the arrow having a plurality of holes extending therethrough from the exterior of the arrow, the inner ends of the holes being in communication with the interior of the shank so that blood can flow into the shank through one or more holes and out of the shank through one or more holes, the walls of the holes being slanted rearwardly toward their outer ends, at least one of the holes being in a mid-portion of the shank and there being at least one hole substantially spaced forwardly of the mid-portion hole and another substantially spaced rearwardly thereof.

A SEVENTH EXAMPLE, U.S. Pat. No. 4,380,340 to Simo teaches a bleeder attachment for arrows which fits over the arrow shaft directly behind the arrowhead. The bleeder attachment body may be bulbous or any other suitable shape, and includes a plurality of barbs which extend outwardly and are disposed toward its front end. A lip on the front end of the bleeder attachment body may be used to secure the bleeder attachment to the arrow by disposing the lip between the arrowhead and the arrow shaft. Grooves may be provided on the outer surface of the bleeder attachment body to promote fluid drainage. The bleeder attachment assures quick and sure killing of an animal hit by an arrow of this invention and is readily removable from the arrow.

AN EIGHTH EXAMPLE, U.S. Pat. No. 4,836,557 to Polando teaches a game tracking arrow that includes a two-part, separable tracking device mountable between the broadhead and the shaft of an arrow. The first part or member of the tracking device is in the form of a hollow, tubular housing threadingly attachable at one end to the broadhead. A stop is connected to the second member or stud which is threadingly mounted to and extends outward from one end of the arrow shaft. A collar is formed intermediate the ends of the second member and has a cross section larger than the cross section of the housing. A spool of line is disposed within the housing and is connected at one end to the stud. The stop is separable from the housing when the collar stops penetration of the shaft into the game to cause separation of the stop from the housing and broadhead embedded within the animal enabling the shaft to fall to the ground and the line to unwind from the spool as the game moves from the location of the shaft on the ground. In one embodiment, a plurality of resilient fingers are formed adjacent the second end of the first member and retain the stop to separably attach the second member to the first member. In another embodiment, a biasing member is mounted on the second member and is compressible between the second member and the side wall of the first member to enable sliding retention of the second member in the first member.

A NINTH EXAMPLE, U.S. Pat. No. 6,015,357 to Rizza teaches a broadhead for use as both an expandable blade head and a fixed blade head. The broadhead includes a shaft, a blade assembly, and locking apparatus. The locking apparatus operatively connected to the blade assembly comprises a disk having three slots, which when desired, can be rotatively aligned so as to prevent the distal ends of the bodies the blade assembly from leaving the slots thereby selectively maintaining the blade assembly in a retracted mode. The blade assembly has an elastic ring which extends around the hypothenuse of each blade and in one annular groove in the body of the blade assembly when the blade assembly is in the retracted mode, with the tension of the elastic ring and the one annular groove chosen determining amount of force necessary for the blade assembly to achieve the expanded position, and with the blade assembly achieving the expanded position after the blade assembly has entered a prey and the barb on each blade contacts hard tissue causing the three blades to pivot outwardly and backwardly until the base of each bade seats in the associated slot in the body of the blade assembly and the elastic ring jumps out of the one annular groove and becomes lodged around the base of each blade, between the projection thereon and the hypothenuse thereof, causing the blade assembly to be maintained in the expanded position.

It is apparent that numerous innovations for arrow related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an arrow for providing an exit for fluid from game upon impact in the game so as to make a quicker and ethical kill of the game and provide a trail to follow to locate the game that avoids the disadvantages of the prior art.

ANOTHER OBJECT of the present invention is to provide an arrow for providing an exit for fluid from game upon impact in the game so as to make a quicker and ethical kill of the game and provide a trail to follow to locate the game that is simple to use.

BRIEFLY STATED, STILL YET ANOTHER OBJECT of the present invention is to provide an arrow including a shaft and an adapter. The adapter portion is initially in an extended position where its rearwardmost end closes a fluid-entering throughslot in a leading portion of the shaft to prevent air intake therethrough and eddy currents produced thereby that effect flight of the arrow, but upon, and by, impact in the game, the adapter portion is moved to a retracted position where its rearwardmost end is moved rearwardly allowing the fluid-entering throughslot to communicate with a pin-riding/fluid entering throughslot in the adapter portion and provide an entrance for fluid from game to enter, then run through a fluid-carrying conduit in the adapter portion, and then out of a fluid-exiting throughbore in the leading portion of the shaft so as to make a quicker and ethical kill of the game and provide a trail to follow to locate the game.

BRIEF DESCRIPTION OF THE DRAWING

The figures of the drawing are briefly described as follows.

LIST OF REFERENCE NUMERALS UTILIZED IN THE DRAWING

Figure 1:
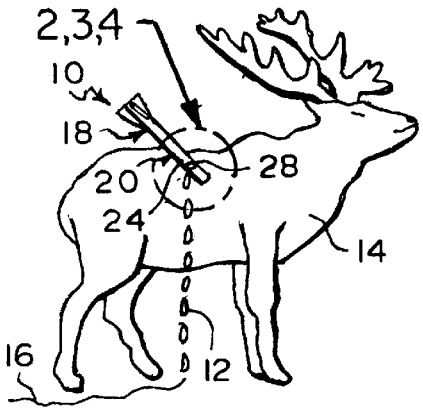
FIG. 1 is a diagrammatic side elevational view of the present invention in use.

| | |
|---|---|
| 10 | arrow of present invention for providing exit for fluid 12 from game 14 upon impact in game 14 so as to make quicker and ethical kill of game 14 and provide trail 16 to follow to locate game 14 |
| 12 | fluid from game 14 |
| 14 | game |
| 18 | shaft |
| 20 | leading portion of shaft 18 |
| 22 | adapter portion |
| 24 | rearwardmost end of leading portion 20 of shaft 18 |
| 26 | forwardmost end of leading portion 20 of shaft 18 |
| 28 | fluid-exiting throughbore in leading portion 20 of shaft 18 |
| 30 | fluid-entering throughslot in leading portion 20 of shaft 18 |
| 32 | pin-receiving throughbore in leading portion 20 of shaft 18 |
| 34 | rearwardmost end of adapter portion 22 |
| 36 | forwardmost end of adapter portion 22 |
| 38 | O-ring of adapter portion 22 |
| 40 | pin-riding/fluid-entering throughslot in adapter portion 22 |
| 42 | fluid-carrying conduit in adapter portion 22 |
| 44 | point of adapter portion 22 for piercing game 14 |
| 46 | pin |

DETAILED DESCRIPTION OF THE PREFERRED EMBODIMENT

Referring now to the figures, in which like numerals indicate like parts, and particularly to FIG. 1, the arrow of the present invention is shown generally at 10 for providing an exit for fluid 12 from game 14 upon impact in the game 14 so as to make a quicker and ethical kill of the game 14 and provide a trail 16 to follow to locate the game 14.

Figure 2:
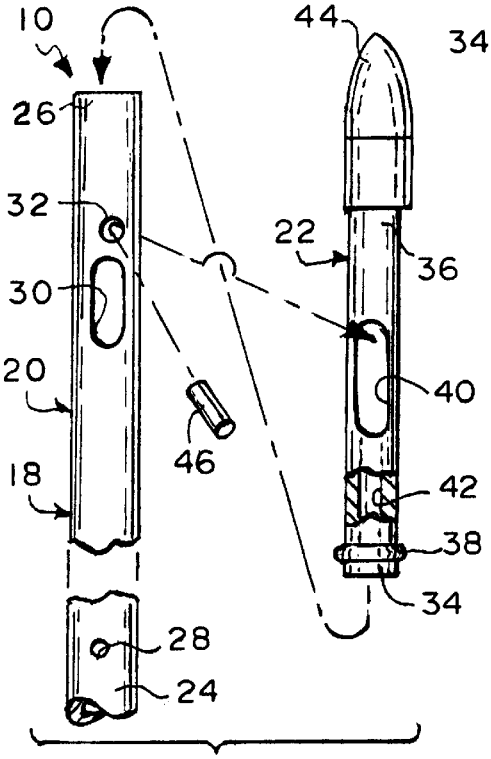
FIG. 2 is an exploded diagrammatic side elevational view of the area generally enclosed by the dotted curve identified by arrow 2 in FIG. 1 of the present invention.

The configuration of the arrow 10 can best be seen in FIG. 2, and as such, will be discussed with reference thereto.

The arrow 10 comprises a shaft 18 with a leading portion 20, and an adapter portion 22. The adapter portion 22 is movably attached to the leading portion 20 of the shaft 18.

The leading portion 20 of the shaft 18 is cylindrically-shaped, tubular, slender, elongated, and has a rearwardmost end 24 and a forwardmost end 26.

The leading portion 20 of the shaft 18 further has a fluid-exiting throughbore 28. The fluid-exiting throughbore 28 extends radially through the leading portion 20 of the shaft 18, and is disposed in close proximity to the rearwardmost end 24 of the leading portion 20 of the shaft 18.

The leading portion 20 of the shaft 18 further has a fluid-entering throughslot 30. The fluid-entering throughslot 30 is slender and elongated, extends axially completely through the leading portion 20 of the shaft 18, and is disposed substantially midway between the forwardmost end 26 of the leading portion 20 of the shaft 18 and the rearwardmost end 24 of the leading portion 20 of the shaft 18, forward of the fluid-exiting throughbore 28 in the leading portion 20 of the shaft 18.

The leading portion 20 of the shaft 18 further has a pin-receiving throughbore 32. The pin-receiving throughbore 32 extends radially completely through the leading portion 20 of the shaft 18, and is disposed in line with, and Just forward of, the fluid-entering throughslot 30 in the leading portion 20 of the shaft 18.

The adapter portion 22 is cylindrically-shaped, rod-like, slender, elongated, and has a rearwardmost end 34 and a forwardmost end 36.

The adapter portion 22 is telescopically received in the leading portion 20 of the shaft 18, with the rearwardmost end 34 of the adapter portion 22 entering through the forwardmost end 26 of the leading portion 20 of the shaft 18.

The adapter portion 22 has a retracted position where it is retracted in the leading portion 20 of the shaft 18 and an extended position where it is extended from the leading portion 20 of the shaft 18.

The adapter portion 22 further has an O-ring 38. The O-ring 38 extends circumferentially completely around the adapter portion 22, is disposed in close proximity to the rearwardmost end 34 of the adapter portion 22, and inhibits movement of the adapter portion 22 in the leading portion 20 of the shaft 18 for preventing retraction of the adapter portion 22 into the leading portion 20 of the shaft 18 prior to impact of the arrow 10 in the game 14.

The adapter portion 22 further has a pin-riding/fluid-entering throughslot 40. The pin-riding/fluid-entering throughslot 40 is slender, elongated, extends axially completely through the adapter portion 22, is disposed substantially midway between the forwardmost end 36 of the adapter portion 22 and the rearwardmost end 34 of the adapter portion 22, and is longer than the fluid-entering throughslot 30 in the leading portion 20 of the shaft 18.

The adapter portion 22 further has a fluid-carrying conduit 42. The fluid-carrying conduit 42 is coaxially disposed in the adapter portion 22, and extends from, and communicates with, the pin-riding/fluid-entering throughslot 40 in the adapter portion 22, to, and communicates with, the rearwardmost end 34 of the adapter 22.

The adapter portion 22 further has a point 44. The point 44 extends coaxially from the forwardmost end 36 of the adapter portion 22 and is for piercing the game 14.

The arrow 10 further comprises a pin 46. The pin 46 enters the pin-receiving throughbore 32 in the leading portion 20 of the shaft 18 and the pin-riding/fluid-entering throughslot 40 in the adapter portion 22 so as to limit movement of the adapter portion 22 in the leading portion 20 of the shaft 18 to only between the retracted position thereof and the extended position thereof.

The operation of the arrow 10 can best be seen in FIGS. 3 and 4, and as such, will be discussed with reference thereto.

Figure 3:
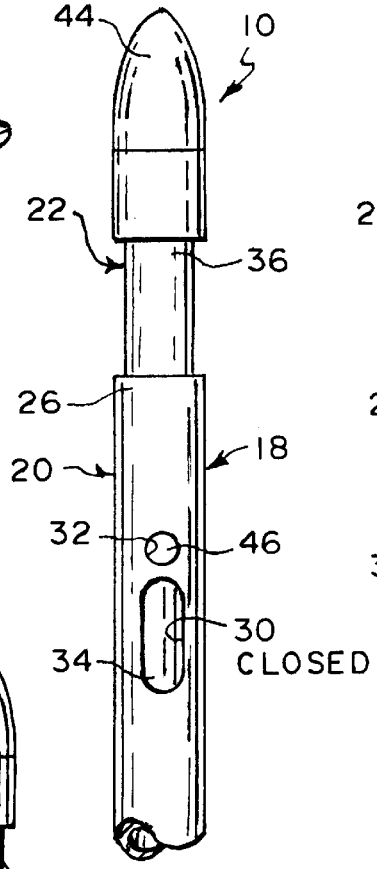
FIG. 3 is an enlarged diagrammatic side elevational view of the area generally enclosed by the dotted curve identified by arrow 3 in FIG. 1 of the present invention prior to impact.

As shown in FIG. 3, the adapter portion 22 is initially in the extended position thereof where the rearwardmost end 34 of the adapter portion 22 closes the fluid-entering throughslot 30 in the leading portion 20 of the shaft 18 for preventing air intake therethrough and eddy currents produced thereby that effect flight of the arrow 10.

Figure 4:
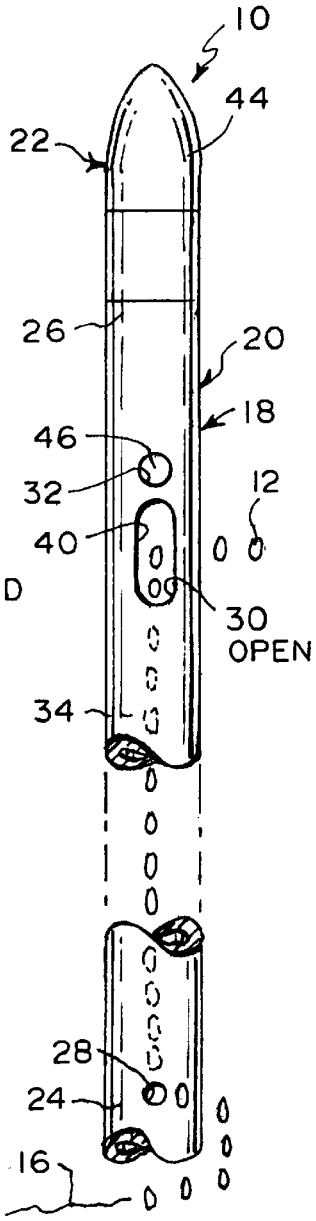
FIG. 4 is an enlarged diagrammatic side elevational view of the area generally enclosed by the dotted curve identified by arrow 4 in FIG. 1 of the present invention after impact.

As shown in FIG. 4, upon, and by, impact in the game 14, the adapter portion 22 is moved to the retracted position thereof where the rearwardmost end 34 of the adapter portion 33 is moved rearwardly allowing the fluid-entering throughslot 30 in the leading portion 20 of the shaft 18 to communicate with the pin riding/fluid entering throughslot 40 in the adapter portion 22 for providing an entrance for the fluid 12 from the game 14 to enter, then run through the fluid-carrying conduit 42 in the adapter portion 22, and then out of the fluid-exiting throughbore 28 in the leading portion 20 of the shaft 18 s0 as to make the quicker and ethical kill of the game 14 and provide the trail 16 to follow to locate the game 14.

It will be understood that each of the elements described above, or two or more together, may also find a useful application in other types of constructions differing from the types described above.

While the invention has been illustrated and described as embodied in an arrow for providing an exit for fluid from game upon impact in the game so as to make a quicker and ethical kill of the game and provide a trail to follow to locate the game, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An arrow for providing an exit for fluid from game upon impact in the game so as to make a quicker and ethical kill of the game and provide a trail to follow to locate the game, said arrow comprising:

a) a shaft; and b an adapter portion;

wherein said shaft has a leading portion; and wherein said adapter portion is movably attached to said leading portion of said shaft, wherein said leading portion of said shaft has a rearwardmost end; and wherein said leading portion of said shaft has a forwardmost end, wherein said leading portion of said shaft has a fluid-exiting throughbore;

wherein said fluid-exiting throughbore extends radially through said leading portion of said shaft; and wherein said fluid-exiting throughbore is disposed in close proximity to said rearwardmost end of said leading portion of said shaft, wherein said leading portion of said shaft has a fluid-entering throughslot;

wherein said fluid-entering throughslot in said leading portion of said shaft is slender; and wherein said fluid-entering throughslot in said leading portion of said shaft is elongated, wherein said fluid-entering throughslot in said leading portion of said shaft extends axially completely through said leading portion of said shaft; and wherein said fluid-entering throughslot in said leading portion of said shaft is disposed substantially midway between said forwardmost end of said leading portion of said shaft and said rearwardmost end of said leading portion of said shaft, forward of said fluid-exiting throughbore in said leading portion of said shaft, wherein said leading portion of said shaft has a pin-receiving throughbore;

wherein said pin-receiving throughbore extends radially completely through said leading portion;

wherein said pin-receiving throughbore is disposed in line with said fluid-entering throughslot in said leading portion of said shaft; and wherein said pin-receiving throughbore is disposed just forward of said fluid-entering throughslot in said leading portion of said shaft, wherein said adapter portion has a rearwardmost end; and wherein said adapter portion has a forwardmost end, wherein said adapter portion has a retracted position where it is retracted in said leading portion of said shaft; and wherein said adapter portion has an extended position where it is extended from said leading portion of said shaft, wherein said adapter portion has a pin-riding/fluid-entering throughslot;

wherein said pin-riding/fluid-entering throughslot in said adapter portion is slender; and wherein said pin-riding/fluid-entering throughslot in said adapter portion is elongated, wherein said adapter portion is initially in said extended position thereof where said rearwardmost end of said adapter portion closes said fluid-entering throughslot in said leading portion of said shaft for preventing air intake therethrough and eddy currents produced thereby that effect flight of said arrow, but upon, and by, impact in the game, said adapter portion is moved to said retracted position thereof where said rearwardmost end of said adapter portion is moved rearwardly allowing said fluid-entering throughslot in said leading portion of said shaft to communicate with said pin-riding/fluid entering throughslot in said adapter portion for providing an entrance for the fluid from then game to enter, then run through said fluid-carrying conduit in said adapter portion, and then out of said fluid-exiting throughbore in said leading portion of said shaft so as to make the quicker and ethical kill of the game and provide the trail to follow to locate the game.

2. The arrow as defined in claim 1, wherein said leading portion of said shaft is cylindrically-shaped;

wherein said leading portion of said shaft is tubular;

wherein said leading portion of said shaft is slender; and wherein said leading portion of said shaft is elongated.

3. The arrow as defined in claim 1, wherein said adapter portion is cylindrically-shaped;

wherein said adapter portion is rod-like;

wherein said adapter portion is slender; and wherein said adapter portion is elongated.

4. The arrow as defined in claim 1, wherein said adapter portion is telescopically received in said leading portion of said shaft; and wherein said rearwardmost end of said adapter portion enters through said forwardmost end of said leading portion of said shaft.

5. The arrow as defined in claim 1, wherein said adapter portion has an O-ring;

wherein said O-ring extends circumferentially completely around said adapter portion;

wherein said O-ring is disposed in close proximity to said rearwardmost end of said adapter portion; and wherein said O-ring inhibits movement of said adapter portion in said leading portion of said shaft for preventing retraction of said adapter portion into said leading portion of said shaft prior to impact of said arrow in the game.

6. The arrow as defined in claim 1, wherein said pin-riding/fluid-entering throughslot extends axially completely through said adapter portion;

wherein said pin-riding/fluid-entering throughslot is disposed substantially midway between said forwardmost end of said adapter portion and said rearwardmost end of said adapter portion; and wherein said pin-riding/fluid-entering throughslot is longer than said fluid-entering throughslot in said leading portion of said shaft.

7. The arrow as defined in claim 1, wherein said adapter portion has a fluid-carrying conduit;

wherein said fluid-carrying conduit is coaxially disposed in said adapter portion;

wherein said fluid-carrying conduit extends from said pin-riding/fluid-entering throughslot in said adapter portion, to said rearwardmost end of said adapter;

wherein said fluid-carrying conduit communicates with said pin-riding/fluid-entering throughslot in said adapter portion; and wherein said fluid-carrying conduit communicates with said rearwardmost end of said adapter.

8. The arrow as defined in claim 1, wherein said adapter portion has a point;

wherein said point extends coaxially from said forwardmost end of said adapter portion; and wherein said point is for piercing the game.

9. The arrow as defined in claim 1; further comprising a pin;

wherein said pin enters said pin-receiving throughbore in said leading portion of said shaft and said pin-riding/fluid-entering throughslot in said adapter portion so as to limit movement of said adapter portion in said leading portion of said shaft to only between said retracted position thereof and said extended position thereof.

* * * * *